United States Patent [19]

Rippe, Jr. et al.

[11] Patent Number: 4,711,603

[45] Date of Patent: Dec. 8, 1987

[54] SLAB JACKING PROCESS AND APPARATUS

[75] Inventors: Dondeville M. Rippe, Jr., Edgewater; David T. Scaturro, Littleton, both of Colo.

[73] Assignee: Magnum Piering, Inc., St. Louis, Mo.

[21] Appl. No.: 705,202

[22] Filed: Feb. 25, 1985

[51] Int. Cl.[4] ..... E02D 7/02

[52] U.S. Cl. ..... 405/230; 403/379; 430/196

[58] Field of Search ..... 405/230, 196; 403/378, 403/379

[56] References Cited

U.S. PATENT DOCUMENTS

| | | | |
|---|---|---|---|
| 2,982,103 | 5/1961 | Revesz et al. | 405/230 |
| 3,613,221 | 10/1971 | Pronk | 403/379 |
| 3,796,055 | 3/1974 | Mahony | 405/230 |
| 3,852,970 | 12/1974 | Cassidy | 405/230 |
| 3,902,326 | 9/1975 | Langenbach, Jr. | 405/230 |

FOREIGN PATENT DOCUMENTS

| | | | |
|---|---|---|---|
| 870137 | 6/1961 | United Kingdom | 405/230 |

*Primary Examiner*—Alan Cohan

*Assistant Examiner*—John A. Rivell

*Attorney, Agent, or Firm*—Gravely, Lieder & Woodruff

[57] ABSTRACT

A concrete slab which has settled is stabilized and may even be lifted by forcing a pier through the slab and into the underlying soil and then attaching the pier at its upper end to the slab. To this end a vertical hole is drilled through the slab as is a smaller oblique hole, with the latter intersecting and passing through the former. Then a jacking unit is attached to the upper surface of the slab around the vertical hole. The jacking unit forces a succession pier sections through the vertical hole and into the underlying soil, with these sections being fitted together end-to-end to form a pier. In time significant resistance is encountered, and at this point, while the jacking unit exerts a downwardly directed force on the pier and an upwardly directed counter-force on the slab, a hole is drilled through the portion of the pier that is within the slab, this being done by using the oblique hole in the slab as a guide for the drill bit. Then a pin is inserted into the oblique hole and driven into the aligned hole in the pier such that it projects from both sides of the pier and has its ends in the oblique hole. Thus, when the jack is removed, the pier supports the slab.

17 Claims, 11 Drawing Figures

FIG. 3
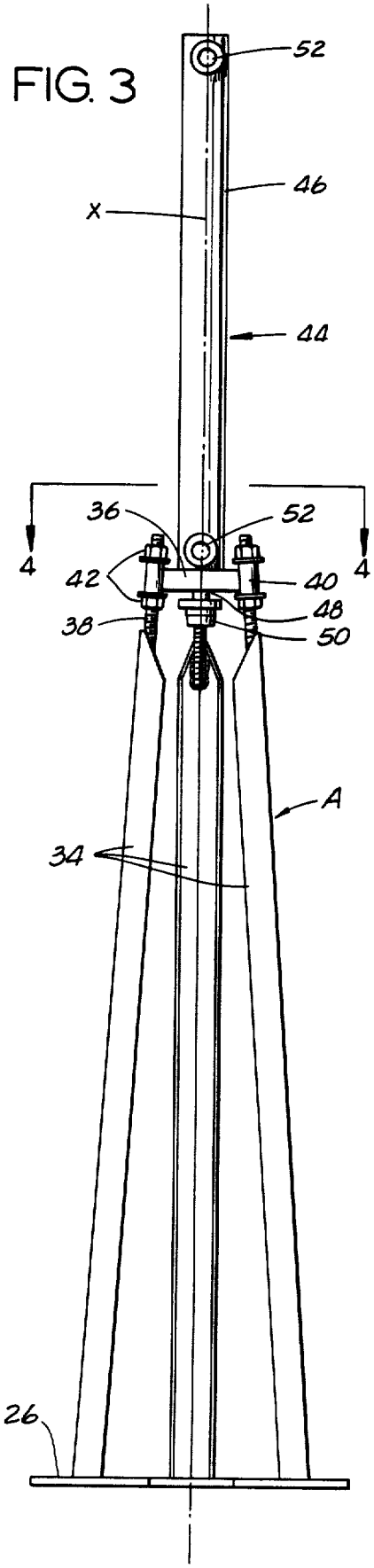
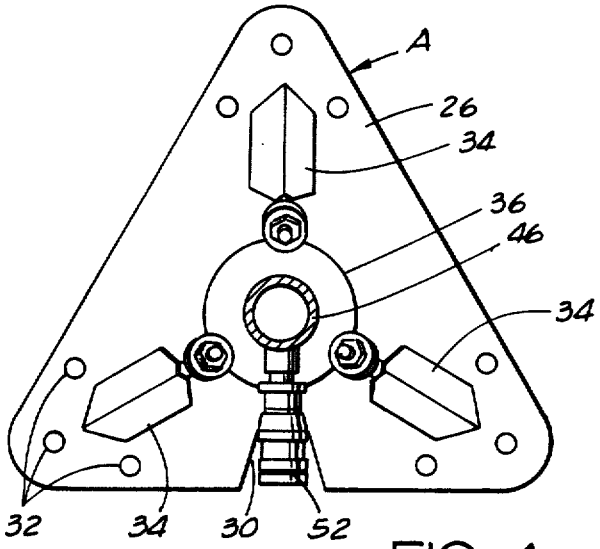
FIG. 4
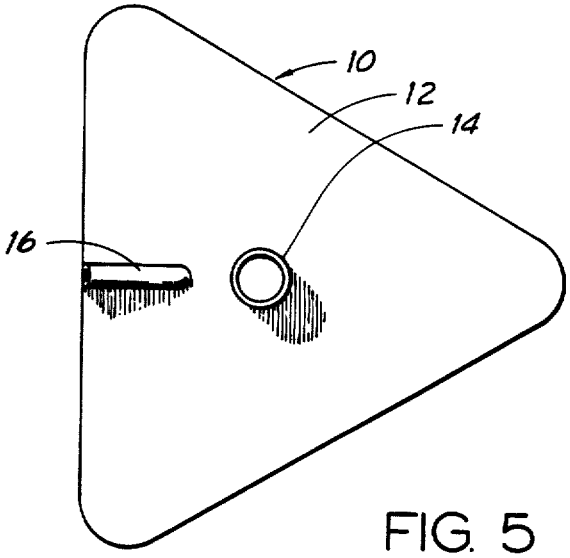
FIG. 5
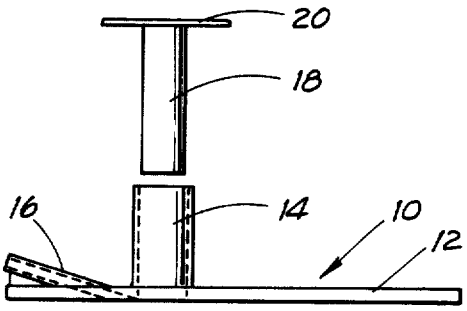
FIG. 6

SLAB JACKING PROCESS AND APPARATUS

BACKGROUND OF THE INVENTION

This invention relates in general to concrete pavement and more particularly to a process and apparatus for supporting and stabilizing such pavement.

Much of the pavement in this country, whether it be at commercial, residential or institutional sites, takes the form of concrete slabs that have been poured directly over the underlying surface that they cover. Sometimes the underlying surface is not stable or washes away, in which case the slab is likely to sink. A sunken concrete slab not only fails to align with adjacent slabs, but often is not level or else does not possess the correct pitch.

Of course, a sunken slab may be broken apart, removed, and thereafter be replaced with a new slab which is poured in a like manner. Concrete work of this nature is quite expensive, and often the region in which it must be performed is not accessible to heavy concrete trucks.

Another corrective procedure, which is known as mud jacking, involves pumping a slurry of mud and cement at high pressure beneath the slab where it fills voids in that region and exerts an upwardly directed force on the slab. The force may be great enough to elevate the slab, but even so, the process is difficult to control. As a consequence, the slab may not rise to the desired elevation or may acquire an undesired pitch. Furthermore, the slurry, being at high pressure, is difficult to contain and may escape from the side of the slab. It may also find its way into sewer pipes and drains to perhaps block them.

SUMMARY OF THE INVENTION

One of the principal objects of the present invention is to provide a process for supporting and stabilizing concrete slabs with a considerable amount of control and precision. Another object is to provide a process of the type stated which may be further used to elevate slabs. An additional object is to provide a process of the type stated which may be practiced at relatively inaccessible locations. A further object is to provide a process of the type stated which leaves the slab with a permanent underlying support so that it is not likely to again settle. Still another object is to provide a process of the type stated which is simple and inexpensive to perform. Yet another object is to provide an apparatus for stabilizing concrete slabs. These and other objects and advantages will become apparent hereinafter.

DESCRIPTION OF THE DRAWINGS

In the accompanying drawings which form part of the specification and wherein like numerals and letters refer to like parts wherever they occur

FIG. 3 is an elevational view of the jacking unit of the present invention;

FIG. 4 is a sectional view of the jacking unit taken along line 4—4 of FIG. 3;

FIG. 5 is a plan view of a drilling template used in the process;

FIG. 6 is a side elevational view of the drilling template; and

DETAILED DESCRIPTION

Figure 1:
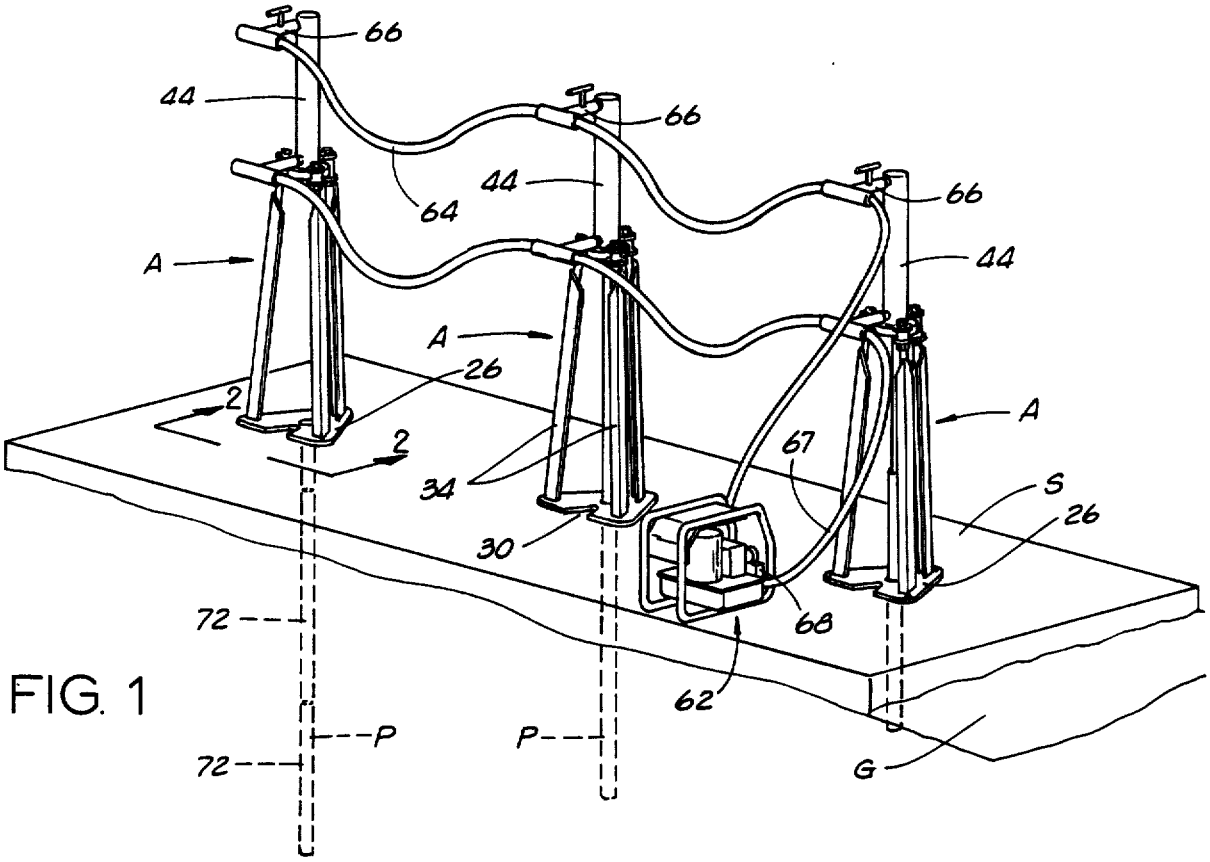
FIG. 1 is a perspective view of a slab to which three jacking units of the present invention are attached for stabilizing the slab.

Referring now to the drawings, a sunken slab S (FIG. 1) is elevated and stabilized with considerable control and precision using several jacking units A which are attached to the slab S. Actually, each jacking unit A forces a supporting pier P downwardly through the slab S and into the ground beneath the slab S until the pier P meets with enough resistance to stabilize the slab S. In this regard, each jacking unit A is attached to the slab S, so that the downwardly directed force exerted by it is resisted by an upwardly directed counterforce applied to the slab S. Once enough resistance is encountered, the jacking units A may jack against their respective piers P to bring the slab S to the desired elevation or to merely stabilize the slab S. The piers P are fastened to the slab S so that they continue to support the slab S in its elevated position.

The slab S is in most instances concrete paving, such as a section of sidewalk or driveway, or a garage floor, or a porch deck, or the floor of a basement, or even a floor located at grade in some building, which has been derived in the typical manner, that is by pouring concrete mix onto a supporting surface G and confining the mix within a suitable form until it hardens. The supporting surface G may be nothing more than dirt, or more likely crushed stone over dirt. Dirt, however, may not be very stable and further may wash away if not properly drained. In any event, the dirt beneath the supporting surface G shifted, causing the surface G to drop and the slab S along with it.

Since each jacking unit A exerts considerable force on slab S, the slab S must be capable of accommodating the jacking force, hopefully without cracking. To this end the slab S should be at least about 2½ inches thick and preferably should contain wire mesh or some other type of reinforcement. Normally several jacking units A are used at once, with the units A being spaced about 5 to 6 feet apart (FIG. 1). The units A should further be located no closer than about one foot from the edge of the slab that is to be supported.

Figure 7A:
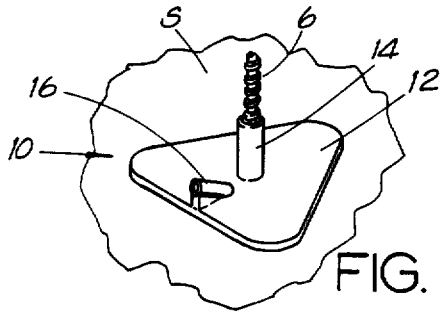
FIGS. 7*a, b, c, d,* and *e* are perspective views showing the steps sequentially for stabilizing a slab using the process of the present invention.
Figure 7B:
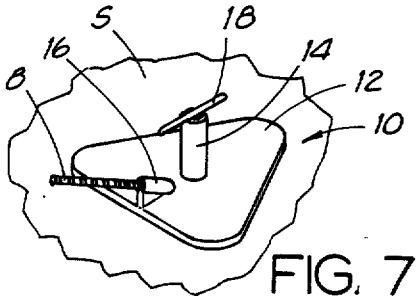

Thus, the first step in the stabilizing process is selecting the locations at which the jacking units A are to be placed. At each location a hole 2 (FIG. 2) is drilled vertically through the slab S and then another, although smaller, hole 4 is drilled oblique to the hole 2. Indeed, the axis of the oblique hole 4 should intersect the axis of the vertical hole 2, and the oblique hole 4 should further exist on both sides of the hole 2. The oblique hole 4 extends from the upper surface of the sunken slab S to the hole 2 and thence beyond the hole 2 for at least about 2 inches and preferably through the bottom of the slab S. The angle between the axes of the two holes 2 and 4 should range between 55° and 65° and should preferably be about 60°. In diameter, the vertical hole 2 should be large enough to enable the pier P to pass through it, and where a 1⅜ inch diameter pier P is used, 1⅜ inches will suffice for the diameter of the hole 2. The oblique hole 4 may be ½ inches in diameter. The vertical hole 2 is drilled with a bit 6 (FIG. 7*a*), while the oblique hole 4 is drilled with a smaller diameter bit 8 (FIG. 7*b*). Both bits 6 and 8 are conventional masonry or concrete bits, and as such each has a carbide tip and spiral flutes leading away from the tip. Each is chucked into and turned by a conventional rotary-impact drill.

To give the holes 2 and 4 the proper orientation with respect to the slab S and with respect to each other, they are drilled through a template 10 (FIGS. 5, 6, & 7a, b) which is placed over each location at which a jacking unit A is to be attached to the slab S. The drilling template 10 includes a flat base plate 12, which may have a triangular configuration, and guide sleeve 14 which is welded to the plate 12 and projects upwardly from it, the axis of the sleeve 14 being perpendicular to the plate 12. The inside diameter of the sleeve 14 is large enough to accommodate the bit 6 while it is rotating, yet is small enough to keep the rotating bit perpendicular to the slab S. Of course, the base plate 12 has an aperture at the lower end of the guide sleeve 14 to enable the bit 6 to pass completely through the template 10 and into the underlying slab S. In addition to the vertical guide sleeve 14, the template 10 is further provided with an oblique guide sleeve 16 which is likewise welded to the base plate 12, but is offset with respect to the vertical sleeve 14 with its axis at an angle of about 30° with respect to the plate 12. Moreover, the oblique sleeve 16 is positioned such that its axis intersects the axis of the vertical sleeve 14 about 3 inches below the bottom surface of the plate 12 where the included angle between the two axes is thus 60°. The inside diameter of the oblique sleeve 16 is large enough to accommodate the bit 8 for the oblique hole 4 while allowing that bit to rotate, and indeed the interior of the sleeve 16 opens out of the bottom of the plate 12 through an aperture in the plate 12. Yet, the inside diameter of the oblique sleeve 16 is small enough to guide the bit 8 into the slab S at an angle of about 30° with respect to the surface of the slab S.

The template 10 is used with a locating pin 18 (FIG. 6) that fits into the vertical guide sleeve 14 and is several inches longer than the sleeve 14. At its upper end, the pin 18 has a handle 20 which prevents the pin 18 from dropping completely through the sleeve 14.

In order to drill the holes 2 and 4, the drilling template 10 is placed on the slab S at the location selected for installation of the jacking unit A. Then the large bit 6 is inserted through the vertical guide sleeve 14 and turned, while repeated impacts are delivered to it (FIG. 7a). The bit 6 bores into and through the slab S, leaving a vertical hole 2 in the slab S. When the bit is withdrawn, the locating pin 18 is inserted into the vertical guide sleeve 14 and allowed to drop into the vertical hole 2 (FIG. 7b). The pin 18 thus maintains the sleeve 14 in axial alignment with the hole 2.

Next, with the locating pin 18 holding the template 10 in place, the oblique hole 4 is drilled into the slab S by inserting the other bit 8 through the oblique guide sleeve 16 (FIG. 7b). As the bit 8 turns with repeated impacts being delivered to it, the bit 8 bores into the slab S at the inclination of the sleeve 16. The bit 8 advances to the vertical hole 2, thus forming within the slab S the initial portion of the oblique hole 4. While the pin 18 serves to locate the template 10 with respect to the vertical hole 2, it is desirable to hold the template 10 down against the slab S while the initial portion of the oblique hole 4 is bored, or at least while that hole is started, because the hole 4 is at a substantial angle with respect to the slab S. This may be achieved by having an individual stand on the base plate 12 of the template 10 while the drill bit 8 moves into the slab S and advances toward the vertical hole 4.

When the small bit 8 reaches the vertical hole 2, the locating pin 18 is removed from the vertical guide sleeve 14, and the bit 8 is allowed to pass obliquely through the hole 2 and thereafter bore into the slab S at the opposite side of the hole 2, thus continuing the oblique hole 4 beyond the opposite side of the vertical hole 2. The oblique hole 4 extends for at least about 2 inches beyond the opposite side of the vertical hole 2 and preferably through the slab S, so that the oblique hole 4 exists on both sides of the vertical hole 2.

Figure 7C:
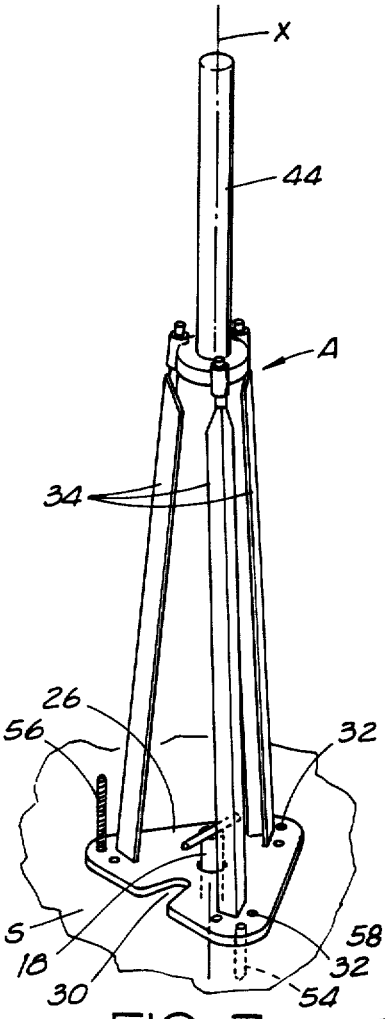

Once the two holes 2 and 4 are bored into the slab S at the location selected for the jacking unit A, the drilling template 10 is removed, and replaced with a jacking unit A that is secured firmly to the slab S at several locations around the vertical hole 2 (FIGS. 7c, d, e). Yet the jacking unit A does not obstruct the end of the oblique hole 4. The jacking unit A has a center axis x, and when the unit A is properly installed, the axis x aligns with the vertical hole 2 in the slab S.

Each jacking unit A includes a base plate 26 (FIGS. 3 & 4) that rests against the upper surface of the slab S at the holes 2 and 4. The base plate 26 possesses a generally triangular configuration, with each side edge measuring about 14 inches, and at its center is provided with a circular hole 28 (FIG. 7d) that lies along the center axis x and is large enough to accommodate the pier P as well as the locating pin 18. Indeed, the latter is used to center the base plate 26 with respect to the vertical hole 2 in the slab S and to thereby align the axis x of the jacking unit A with the vertical hole 2. In addition to the center hole 28, the base plate 12 has a slot 30 which extends inwardly from one of its side edges toward the center hole 28. The slot 30 is wide enough and deep enough to allow the upper end of the oblique hole 4 to remain exposed within the confines of the base plate 26 when the center hole 28 is aligned with the hole 2 in the slab S. The corners of the base plate 26 are arcuate and along each corner, the base plate has three holes 32, each being an equal distance from the edge of the base plate 26. The holes 32 may be ½ inches in diameter.

In addition to the base plate 26, the jacking unit A includes connecting legs 34 (FIGS. 3 & 4) and a ring mount 36, the former supporting the latter in a fixed position above the base plate 26 such that the latter is concentric to the axis x and thereby directly over the center hole 28 in the plate 26. More specifically, the three legs 34 are welded to the upper surface of the base plate 26 slightly inwardly from the corners of that plate, with the point of the attachment for each leg 34 being located between two of the corner holes 32 for the corner from which it extends and immediately inwardly from the remaining corner hole 32. The legs 34 converge upwardly toward the axis x of the jacking unit A and at their upper ends are provided with stud bolts 38. The ring mount 36, on the other hand, has along its sides anchor sleeves 40 through which the stud bolts 38 project. Each anchor sleeve 40 is captured between two nuts 42 that are threaded onto the stud bolt 38 for that sleeve 40, so that the ring mount 36 may be adjusted to a position in which its axis coincides precisely with the axis x of the jacking unit A.

Figure 7D:
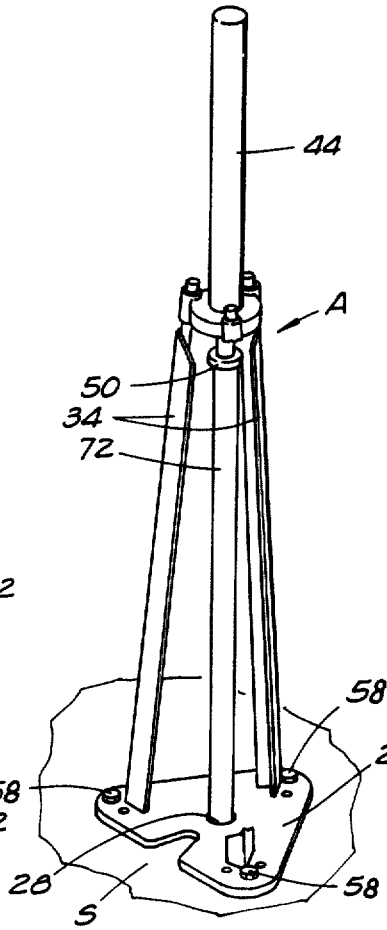

The ring mount 36 supports a double acting hydraulic cylinder 44 (FIG. 3) such that the axis of the cylinder 44 lies along and coincides with the axis x. The cylinder 44 includes a barrel 46, which is at its lower end welded to the ring mount 36, and also a piston rod 48 that moves into and out of the lower end of the barrel 46. As such the piston rod 48 projects through the ring mount 36. At its lower end, the piston rod 48 is fitted with an adapter 50 which is configured to fit into and thereby engage the upper end of the pier P, so that a downwardly directed force may be applied to the pier P without danger of the pier P being displaced laterally (FIG. 7*d*). To this end, the adapter 50 has a flange which is larger in diameter than the pier P and a tapered nose portion which projects downwardly from the flange and is large enough to fit into the hollow interior of the pier P.

To secure the jacking unit A, to the slab so that its cylinder 44 may be used to exert a downwardly directed force on a pier P and an upwardly directed counterforce on the slab S, the base plate 26 of the unit A is placed over the vertical hole 2 with its center hole 28 aligned with the vertical hole 2. The locating pin 18 may be used to facilitate this alignment, just as it was previously used to align the vertical guide sleeve 14 of the drilling template 10 with the vertical hole 2 (FIG. 7*c*). With the locating pin 18 in place, the base 28 is turned until the upper end of the oblique hole 4 is exposed through the slot 30 in the plate 26. Then, using the plate 26 as a template for guiding another concrete bit 60 (FIG. 7*c*), anchor holes 54 are drilled into the slab S with the bit 56. In particular, a single anchor hole 54 is bored into the slab at each corner of the base plate 26, and that hole 54 is drilled from one of the three corner holes 32 at the particular corner where it is located. Usually the center of the three holes 32 at each corner is selected to guide the bit 56, that is the hole 32 directly outwardly from the leg 34 that is attached to the corner, but if for some reason a hole cannot be drilled through the center hole 32, one of the side holes 32 may be used. In any event, a separate anchor hole 54 exists beneath each of the three corners of the base plate 26 for the jacking unit A.

Then the jacking unit A is turned slightly or else removed altogether to expose the anchor holes 54, whereupon anchor bolts 58 (FIG. 7*d*) are driven into the holes 54. The anchor bolts 58 are conventional, with each comprising nothing more than a lead anchor and a threaded shank or stud extending from the anchor. The anchor fits tightly in its hole 54 and indeed the bolt 58 must be driven into the hole 54 with a hammer to set the anchor. When an outwardly directed force is applied to the bolt 58, the anchor tends to expand and seat even more tightly within the hole 54. To avoid damaging the threads at the upper end of the shank for the bolt 58, a nut 60 should be turned down over those threads and the impacts for driving the bolt 58 should be applied against the nut 60.

Once the anchor bolts 58 are set in the slab S around the vertical hole 2, the base plate 26 of the jacking unit A is fitted over them, and as a consequence a separate anchor bolt 58 projects through a corner hole 32 at each corner of the base plate 26 (FIG. 7*d*). The nuts 60, which had previously been removed to allow installation of the plate 26, are then threaded onto the anchor bolts 56 and turned down against the base plate 26 to insure that the plate 26 is firmly secured to the slab S. Where the slab S slopes in the region of the jacking unit A, shims may be placed under the plate 26 to level it, for when the plate 28 is level, the pier P will be driven directly downwardly.

The upper ports 52 of the cylinders 44 for the several jacking units A are connected to a hydraulic pump 62 (FIG. 1) through suitable hoses 64 and shut off valves 66, there being a separate valve 66 at the upper port 52 of each cylinder 44. The lower ports 52 of the cylinders 44 are connected to the pump 62 through another hose 67. The pump 62 possesses a directional valve 68 for directing pressurized fluid to either the hose 64 or the hose 67. The former of course delivers the fluid to the upper ports 52 and causes the piston rods 48 to extend, while the latter delivers it to the lower ports 52 and causes the piston rods 48 to retract. Finally, the pump 62 has a pressure control valve which may be adjusted to vary the pressure of the fluid delivered to the hoses 64 and 67.

Each pier P (FIG. 2) is in essence a hollow steel pipe which is driven far enough into the ground beneath the slab to support a considerable amount of weight—indeed more than the weight of the portion of slab that it is assigned to support together with any load that is on that portion of the slab S. In many instances the lower end of the pier P will be against bed rock. The upper end of the pier P is secured to the slab S by a pin 70 which projects from both sides of the pier P and into the portions of the oblique hole 4 that exist on each side of the vertical hole 2. The pin 70 may be a conventional roll pin of about ½ inch diameter. It should project from about 1½" to 2" from each side of the pier P.

The pier P consists of sections 72 (FIG. 2) which are connected end to end, with each section 72 being short enough to fit within the jacking unit A, that is between the base plate 26 and the adapter 50 of the hydraulic cylinder 44 when the piston rod 48 is retracted (FIG. 7*d*). Each section 72 is formed from steel tubing and at its lower end is swagged inwardly to provide a reduced end portion 74 of a diameter small enough to fit into the upper end of another section 72. The upper end of each pier section 72, on the other hand, is large enough to receive the nose of the adapter 50 on the piston rod 48, so that the flange on the adapter 50 bears against the end edge of the section 72. This enables the cylinder 44 to apply a large downwardly directed force to the section 72 without danger of the section 72 slipping laterally out of engagement with the adapter 50. When one pier section 72 is driven almost entirely through the vertical hole 2 in the slab S, another is engaged with its end and also driven, there being enough sections 72 driven end to end to produce a pier P that encounters substantial resistance.

To stabilize and support the slab S, vertical holes 2 and corresponding oblique holes 4 are bored into the slab S at locations which have been selected for the jacking units A, each set of holes 2 and 4 being bored using the drilling template 10 as a guide for the concrete bits 6 and 8 as previously described. Then a jacking unit A is placed at each set of holes 2 and 4, and using the bit 56, anchor holes 54 are bored into the slab S at the corners of the base plate 28, with corner holes 32 of the base plate 28 this time being used as guides for the bit 60. Then the anchor bolts 58 are set and the base plates 26 of the jacking units A are secured to the slab S with those bolts 58, all in the manner previously described.

Once the jacking units A are installed, the upper and lower ports 52 of their hydraulic cylinders 44 are connected to the hydraulic pump 62 through the hoses 64 and 67 respectively. The directional valve 68 is set to direct fluid from the pump into the hose 64 that leads to the upper ports 52. Moreover, the shut off valves 66 for all but one of the cylinders 44 are closed, the cylinder 44 with the one that is open being for the unit A where the first pier P is to be driven.

Figure 7E:
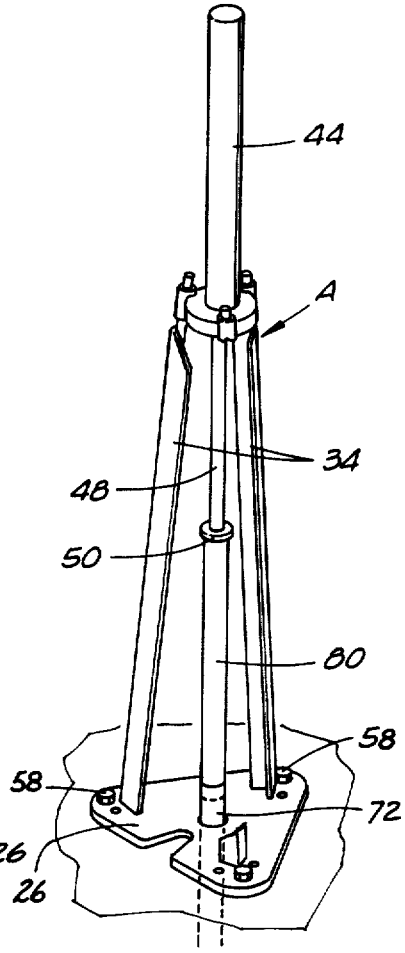

Once the hoses 64 and 67 are connected and the valves 66 and 68 are adjusted, the pump 62 is energized, and it directs pressurized hydraulic fluid to the upper end of the cylinder 44 on one of the jacking units A with the open shut off valve 68. A single pier section 72 is inserted into the vertical hole 2 located in the slab S at this jacking unit A (FIG. 7*d*), with the reduced end portion 74 of that section presented downwardly. The opposite end, which is not distorted is aligned with the adapter 50 on the piston rod 48 of the hydraulic cylinder 44. As the piston rod 48 descends under the force exerted by the pressurized hydraulic fluid admitted into the barrel 46 through the valve 66 and upper port 52, the nose of the adapter 50 enters the upper end of the pier section 72, while the flange of the adapter 50 comes against the end edge of that pier section 72. The piston rod 48 acting through the adapter 50 thereupon exerts a downwardly directed force against the pier section 72. This force is resisted by an equal and opposite counterforce exerted by the slab S, that counterforce being transmitted to the cylinder 44 through the anchor bolts 56 and the plate 26, legs 34 and ring mount 36 of the jacking unit A. The force exerted by the cylinder 44 drives the pier section 72 through the vertical hole 2 and into the ground beneath the slab S. When the piston rod 48 is fully extended, only about one-half of the pier section 72 will be in the ground. At this time, the directional valve at the pump 62 is changed to direct the fluid into the lower end of the cylinder 44 and retract the piston rod 48. Next a drive rod 80 (FIG. 7*e*) is placed between the adapter 50 and the upper end of the partially driven pier section 72, the ends of the drive rod 48 being configured to engage the adapter 50 and the upper end of the pier section 72 such that the drive rod 80 cannot be displaced laterally. Thereupon, the directional valve 68 is turned back to direct the pressurized fluid to the upper port 52 and thus again extend the piston rod 48 whereupon the piston rod 48 drives the pier section 72 almost totally into the ground.

Next the piston rod 48 is retracted to its fullest extent and the drive rod 80 is removed. Another pier section 72 is then fitted into the jacking unit A, its reduced end portion 74, which is presented downwardly, being fitted into the upper end of the previously driven pier section 72. The upper end of the second pier section 72, on the other hand, is aligned with the adapter 50. The piston rod 48 again extends and drives the second pier section 72 partially into the ground, whereupon it is retracted to thereafter extend again and drive the second pier section 72 through a force transmitted through the drive rod 80. This places the two sections 72 end-to-end within the ground.

Additional sections 72 are added to the pier P and are driven in a like manner. When enough resistance is encountered to lift the slab—and this may be ascertained by monitoring the pressure delivered by the pump 62—the valves 66 to the cylinder 44 are closed so that the jacking unit A continues to exert a downwardly directed force on the pier P and at the same time exerts an equal and opposite lifting force on the slab S, the latter being transmitted to the slab S through the anchor bolts 56.

The same procedure is repeated for all of the jacking units A.

Once all of the piers P have been driven to the extent that they encounter a predetermined amount of resistance, which together should be enough to support the slab S and any load it is designed to carry, the upper ports 52 for the cylinders 44 of all of the jacking units A are connected simultaneously to the pump 62 by opening all of the shut off valves 66, so that pressurized fluid is directed simultaneously to the cylinders 44. Each cylinder 44 thus exerts the same amount of force on the pier P beneath it. By thereafter operating the shut off valves 66 independently, the pressure in the several cylinders 44 may be varied, and indeed the jacking forces applied to the slab may be manipulated to lift the slab S back to its original elevation or to a desired elevation and even a desired pitch. When the slab S reaches the desired elevation and pitch, the cylinders 44 are blocked by closing the valves 66, so that the slab S remains supported at that elevation. The cylinders 44 remain in that condition for several minutes to determine if the slab S is truly stabilized. If a cylinder 44 loses pressure, the pier P against which it directs its force has sunk still further and more pressure must be applied to the cylinder 44 of its jacking unit A until the particular pier P is truly stabilized and carries the weight assigned to it.

Figure 2:
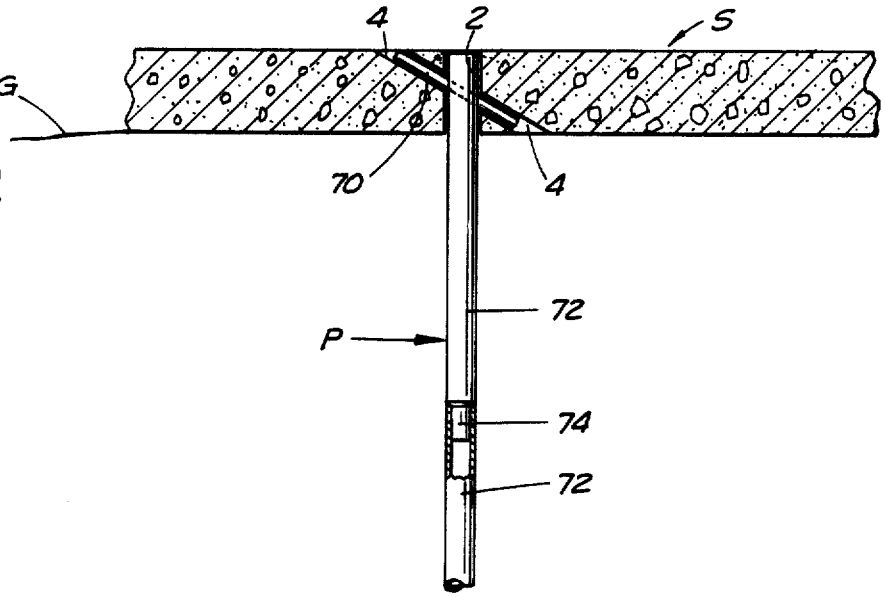
FIG. 2 is a sectional view of the slab taken along line 2—2 of FIG. 1 and showing one of the piers attached to the slab.

Once the piers P are truly stabilized, each is secured to the slab S with a roll pin 70 (FIG. 2). As to each pier P, this involves inserting a drill bit through the oblique hole in the slab at that pier P, and drilling a hole 78 through the portion of the pier P that is within the confines of the vertical hole 2, with the diameter of the hole 78 being such that the hole 78 will snugly receive the roll pin 70. In effect, the hole 78 forms a connection between the two spaced apart sections of the oblique hole 4 in the slab S. Thereupon a roll pin 70 is inserted into the oblique hole, and with a drift is driven completely through the hole 78 in the pier P indeed far enough to have a substantial amount of the roll pin 70 in the portions of the oblique hole 4 on each side of the vertical hole 2.

After the roll pin 70 is set, the pressure in the hydraulic cylinder 44 for the jacking unit A is released, whereupon the slab load previously transmitted through the jacking unit A is transferred to the roll pin 70. In other words, the force which supports the repositioned and stabilized slab S is transmitted from the pier P to the slab S at the roll pin 70.

Thereafter, the jacking unit A is removed altogether by threading the nuts 60 off of their respective anchor bolts 58 and lifting the jacking unit A away from the site. The anchor bolts 56 are driven into the slab S or are else cut off with a cutting torch. The projecting portion of the last section 72 for the pier P is likewise cut off with a torch so that the upper end of the pier P is flush with or slightly below the upper surface of the slab S. The holes 2, 4 and 54 which remain in the slab S are filled with a cement patching mix which upon hardening brings the slab S back to its original appearance.

The piers P remain in place to support the slab S. They prevent the slab S from sinking further, and if the slab S has indeed been raised, they hold it in the elevated condition. Thus, the piers P stabilize the slab S.

Should it be necessary to restabilize the slab S, the roll pins 70 are merely driven through their respective oblique holes 4, assuming that those holes 4 open out of the bottom of the slab S. Then the foregoing stabilization process is repeated using the existing piers P to support additional pier sections 72, if desired.

This invention is intended to cover all changes and modifications of the example of the invention herein chosen for purposes of the disclosure which do not constitute departures from the spirit and scope of the invention.

What is claimed is:

1. A process for stabilizing and supporting a slab of concrete that extends over underlying ground, said process comprising: boring a vertical hole entirely through the slab at a location where the slab is to be supported; boring an oblique hole into the slab from the upper surface thereof, with the oblique hole intersecting the vertical hole and being substantially smaller in diameter than the vertical hole; driving a pier through the vertical hole and into the underlying ground, the pier being small enough to pass through the vertical hole; exerting a downwardly directed force on the pier while at the same time resisting that force with an upwardly directed counterforce applied to the slab in the region of the vertical hole; thereafter while the force and counterforce are applied, drilling a hole transversely through the pier with that hole being axially aligned with the oblique hole in the slab; thereafter while the force and counterforce are applied, inserting a pin through the oblique hole in the slab and into the transverse hole of the pier such that the pin projects from the transverse hole into the oblique hole; and thereafter releasing the force and counterforce, whereby the slab in the region of the vertical hole is supported by the pier.

2. The process according to claim 1 wherein the oblique hole exists on and opens into both sides of the vertical hole and the pin projects into the oblique hole from both sides of the pier.

3. The process according to claim 2 wherein the pier comprises a plurality of sections which fit end-to-end, and the step of driving the pier comprises applying a force to the sections one after the other so that the force when applied to the last section drives all the previous sections.

4. The process according to claim 1 wherein the step of driving the pier and the step of exerting a downwardly directed force each comprise: with a jacking unit that is attached to the slab at a plurality of locations remote from the vertical hole, applying a downwardly directed force to the pier.

5. The process according to claim 4 and further comprising: detaching the jacking unit from the slab after the pin is inserted into the oblique hole of the slab and into the transverse hole of the pier and after the force and counterforce are released.

6. The process according to claim 1 wherein the step of drilling a hole transversely through the pier includes using the oblique hole as a guide for a drill bit that bores through the pier to form the transversely extending hole therein.

7. A process for stabilizing and supporting a slab of concrete that extends over underlying ground, said process comprising: placing a drilling template over the slab at a location thereon where it is desired to support the slab, using the template to guide a drill bit that bores into the slab to provide the slab with a first hole that extends entirely through the slab in the vertical direction; using the template to guide a drill bit that bores into the slab to provide the slab with a second hole that is generally transverse to the first hole and intersects the first hole; securing a jacking unit to the slab in the region of the first hole such that the jacking unit extends upwardly from the slab, the jacking unit including force means for exerting a force that is directed downwardly toward the slab; driving a pier through the first hole and into the ground with a force derived from the force means of the jacking unit, the force being transmitted through the jacking unit and being resisted by the slab; and attaching the pier to the slab when the pier is driven into the ground to the desired depth by providing the pier with a transversely extending hole which aligns with the second hole in the slab and inserting a pin into the transversely extending hole such that a portion of the pin projects into the second hole of the slab.

8. The process according to claim 9 wherein the first hole is bored before the second hole and further comprising inserting a locating pin through the template and into the first hole while the second hole is bored, so that the second hole is located properly with respect to the first hole.

9. A process for stabilizing and supporting a slab of concrete that extends over underlying ground, said process comprising: boring a first hole vertically into and completely through the slab at a location where the slab is to be supported; securing a jacking unit against the upper surface of the slab with anchoring devices that attach to the slab at a plurality of locations spaced from the first hole, the jacking unit including force exerting means that is located above and spaced from the first hole in the slab for exerting a downwardly directed force toward the first hole in the slab; inserting a pier into the first hole; driving the pier through the hole and into the ground by applying a downwardly directed force to the pier with the force exerting means, the force being transmitted through the jacking unit and being resisted by the slab at the anchoring devices, whereby the slab exerts a counterforce on the jacking unit; thereafter while the force and counterforce are applied, attaching the pier to the slab at the first hole such that the slab does not move downwardly over the pier; thereafter releasing the force and counterforce; and thereafter detaching and removing the jacking unit from the slab.

10. The process according to claim 9 wherein the pier comprises a plurality of sections which fit together end-to-end, and the step of driving the pier comprises driving successive pier sections through the first hole and into the ground with the end of each section after the first being fitted to the last section driven through the hole before the force exerting means exerts a downwardly directed force on it.

11. The process according to claim 9 wherein the step of attaching the pier to the slab comprises providing the slab with a second hole that is generally transverse to the first hole and intersects the first hole, providing the pier with a transversely extending hole which aligns with the second hole in the slab, and inserting a pin into the transversely extending hole of the pier such that a portion of the pin projects into the second hole in the slab.

12. The process according to claim 11 wherein the second hole of the slab is oblique to the first hole and at one end opens out of the upper surface of the slab, and the pin is inserted through the second hole from said one end thereof and thence into the transverse hole in the pier.

13. The process according to claim 12 wherein the second hole is located on both sides of the first hole and the pin projects from both sides of the pier into the second hole.

14. The process according to claim 9 wherein the step of securing the jacking unit to the slab includes setting anchors into the slab around the first hole and bolting the jacking unit to the slab at the anchors.

15. The process according to claim 9 wherein the anchoring devices are embedded within the slab at locations spaced from the first hole.

16. The combination comprising: a concrete slab located over underlying ground and having a vertical hole therein and an oblique hole which is substantially smaller than the vertical hole and intersects the vertical hole with its axis being oblique to the axis of the vertical hole; a pier extending through the vertical hole in the slab and thence downwardly into the ground, the pier throughout its length being no greater in diameter than the diameter of the vertical hole; a jacking unit mounted firmly on the slab at a plurality of locations remote from the vertical hole and including means for exerting a downwardly directed force on the pier and an upwardly directed counterforce on the slab; and a pin extending transversely through the pier and into the oblique hole to connect the pier to the slab, the pin transmitting the downwardly directed weight of the slab to the pier when the force exerted by the jacking unit is released, so that the pier thereafter supports the slab.

17. The combination according to claim 16 wherein the jacking unit includes a base which is bolted to the slab around the vertical hole while leaving the end of the oblique hole exposed.

* * * * *

UNITED STATES PATENT AND TRADEMARK OFFICE

CERTIFICATE OF CORRECTION

PATENT NO. : 4,711,603

DATED : December 8, 1987

INVENTOR(S) : Dondeville M. Rippe, Jr. and David T. Scaturro

It is certified that error appears in the above-identified patent and that said Letters Patent is hereby corrected as shown below:

Column 2, line 62, cancel "1-3/8" and substitute therefor "1-5/16".

Column 8, line 31, a hyphen should be inserted between "P" and "indeed".

Column 10, line 7, cancel "to claim 9" and substitute therefor "to claim 7".

Signed and Sealed this

Seventh Day of June, 1988

*Attest:*

*Attesting Officer*

DONALD J. QUIGG

*Commissioner of Patents and Trademarks*